United States Patent [19]

Kehr

[11] Patent Number: 5,002,595

[45] Date of Patent: Mar. 26, 1991

[54] DEBRIS AND WATER VACUUM SYSTEM

[75] Inventor: Edwin A. Kehr, Sarasota, Fla.

[73] Assignee: Samson Metal & Machine, Inc., Lakeland, Fla.

[21] Appl. No.: 295,182

[22] Filed: Jan. 9, 1989

[51] Int. Cl.[5] ..... B01D 45/12; B01D 46/44

[52] U.S. Cl. ..... 55/312; 55/320; 55/337; 55/346; 55/361; 55/444; 55/467

[58] Field of Search ..... 55/312, 320, 337, 429, 55/345–349, 467, 361, 440, 444

[56] References Cited

U.S. PATENT DOCUMENTS

| | | | |
|---|---|---|---|
| 3,780,502 | 12/1973 | Dupre et al. | 55/337 |
| 3,842,461 | 10/1974 | Wurster | 55/467 X |
| 3,870,489 | 11/1975 | Shaddock | 55/337 X |
| 4,062,664 | 12/1977 | Dupre et al. | 55/337 X |
| 4,295,867 | 10/1981 | Shopin et al. | 55/320 X |
| 4,348,057 | 9/1982 | Parenti et al. | 55/337 X |

*Primary Examiner*—Charles Hart

[57] ABSTRACT

A debris and water vacuum system comprising a vacuum pump, a debris receptacle, a first air filter stage, a second filter stage, and valve means for connecting and disconnecting the second air filter stage from a 40 mesh screen final filter and vacuum pump, selectively.

6 Claims, 4 Drawing Sheets

DEBRIS AND WATER VACUUM SYSTEM

BACKGROUND OF THE INVENTION

Debris collection systems typically include a receptacle for storing debris, an intake tube, and means for creating an airflow in the intake tube that draws or carries the debris through the conduit and into the receptacle.

The required airflow is generally created by either an air conveyance system or a vacuum system. Air conveyance systems create an air flow in the conduit which carries debris to the receptacle. Vacuum systems utilize a vacuum pump to create a partial vacuum in the receptacle. Vacuum systems have several advantages over those using air conveyance. For example, air conveyance units use an open exhaust system for their fan or compressor. When the receptacle is filled, contaminates are carried by the air flow system and discharged into the atmosphere, potentially polluting the air. In contrast, vacuum systems are generally completely sealed. When the receptacle is full, the system itself automatically reduces the vacuum to prevent discharge of contaminated material Furthermore, vacuum units, by reason of the vacuum created in the receptacle, are capable of collecting both liquid and solid material. While air conveyance systems are capable of moving solid particulate debris, they are unable to draw up large amounts of liquid. Vacuum systems are well suited for liquid pickup since submerging the end of the intake tube below the water level maintains the vacuum in the system.

SUMMARY OF THE INVENTION

The debris and water vacuum system of the instant invention utilizes an improved air flow pattern to maximize efficiency of the system.

A hydrostatic motor is used to power a vacuum pump as opposed to utilizing the truck's drive train. Use of a hydrostatic drive powered off the vehicle engine requires only that a pair of hydraulic lines be connected from a hydrostatic pump to the hydrostatic motor which in turn drives the vacuum pump.

The vacuum pump is sized to move in excess of 5,000 CFM in the no-load condition and, when operating at 1,800 rpm and drawing 16 inches of vacuum, is sized to move approximately 4,200 CFM through an eight-inch pipe.

Debris enters the system receptacle through a port located on the rear bulkhead at the top thereof. Debris-ladened air first encounters an air scrubber comprising a number of spaced vertical plates that are orientated to one side of the air flow entry path, continue at a slight angle to the air flow until a point approximately three quarters of the distance of the receptacle, and then cross the air stream. When debris-ladened air enters the receptacle, the lighter particles diverge from the airstream, thereby precipitating out some of the very light materials which are deposited in the rear of the receptacle. Heavier particles continue on in the airstream and fall out in relation to density, lighter materials first, heavier materials toward the front of the receptacle.

Dust that escapes the scrubber inside the receptacle is ducted equally to seven high efficiency cyclones. The cyclones remove any large dust particles which drop downwardly into a collection bin located below the cyclones. Relatively clean air flows out of the cyclones through the top thereof and is ducted to either a 40 mesh screen and the vacuum pump or to a second air filter chamber on the opposite side of the debris receptacle termed a "baghouse", thence to the 40 mesh screen and vacuum pump.

Air entering the "baghouse" is drawn upwardly through 56 four-inch by 48-inch polypropylene cloth filter bags. At this point air is filtered to remove all particles one micron or larger. The relatively clean air is pulled off the top of the bags, through the 40 mesh screen final filter, thence ducted into a plenum below the vacuum pump, then up through the vacuum pump, then exhausted.

DETAILED DESCRIPTION OF THE PREFERRED EMBODIMENT OF THE INVENTION

Figure 1:
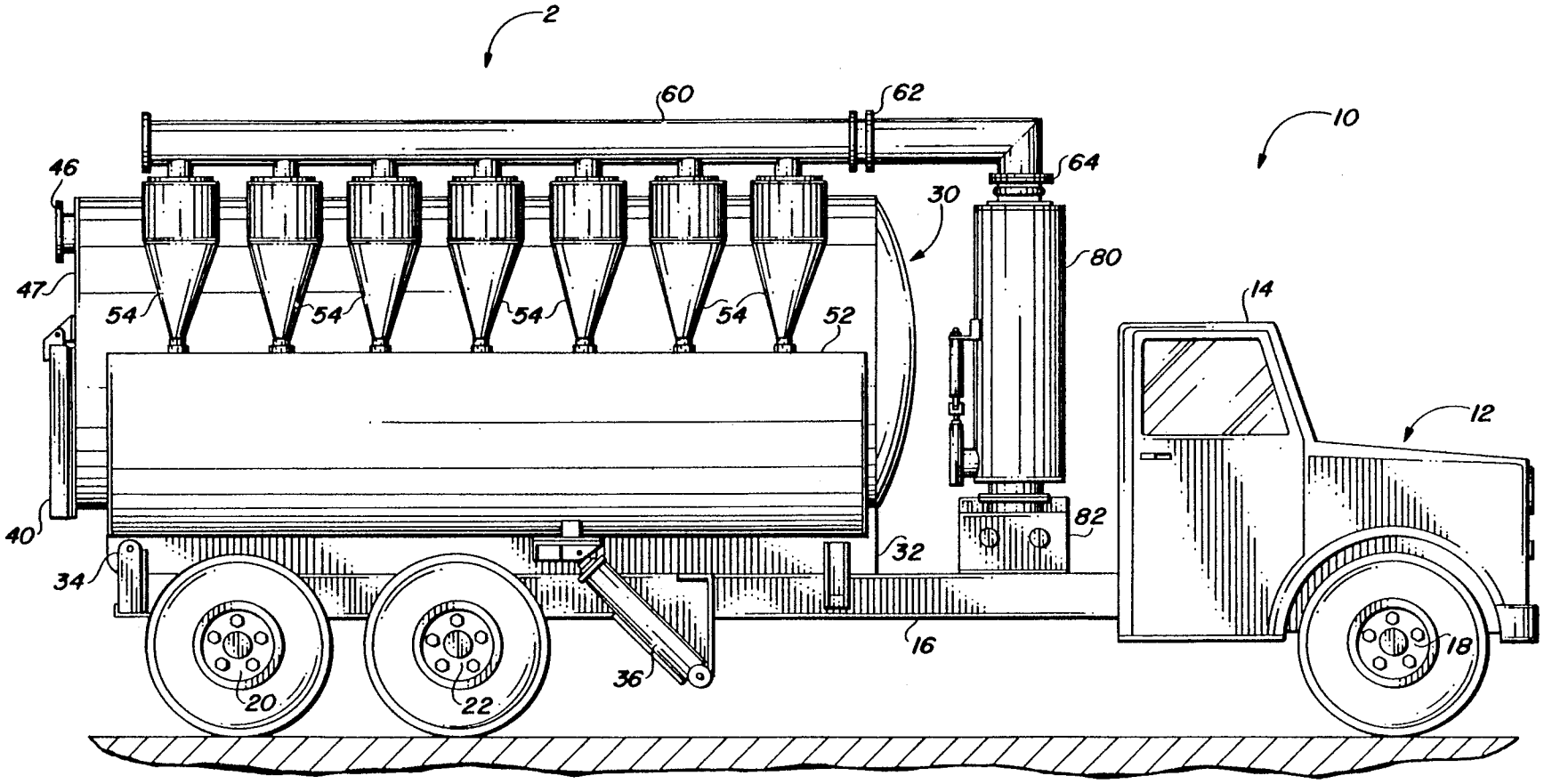
FIG. 1 is an elevational view of a vacuum system of the instant invention mounted on a heavy duty truck.

Referring to FIG. 1 of the drawings, a debris and water vacuum system 10 in accordance with the present invention is shown mounted on a truck 12 of conventional design comprising a driver's cab 14, and a frame 16. The truck frame 16 supports a front axle unit 18 and dual rear axle units 20 and 22.

The vacuum system 10 of the instant invention comprises a cylindrical debris and water receptacle 30 that is mounted on a receptacle frame 32 which rests upon the vehicle frame 16. The receptacle frame 32 is pivoted to the vehicle frame 16 by pivot pin 34. The receptacle frame 32 and cylindrical receptacle 30 are rotated about the pins 34 to effect elevation of the receptacle 30 and discharge of materials by a pair of hydraulic cylinders 36, one of which is shown in FIG. 1 of the drawing. A rear door 40 on the receptacle 30 is pivotally supported by pins 42 so as to be rotatable to the open condition for debris discharge when the receptacle 30 is elevated by the hydraulic cylinders 36.

Air and debris are inducted into the receptacle 30 through a connector 46 on a rear bulkhead 47 thereof. The connector 46 extends longitudinally of the container 30 into communication with an air scrubber 48 comprising a plurality of vertically extending angularly related plates 49 which are aligned at an angle to the longitudinal axis of the receptacle 30. The aligned array of plates 49 crosses the center of the airflow through the intake connector 46, thereby impacting debris entrained in the flowing air in a manner whereby lighter particles are initially impacted and dropped due to dispersion thereof and relatively larger particles are carried forwardly of the receptacle 30 to be deposited at the front end thereof.

Figure 4:
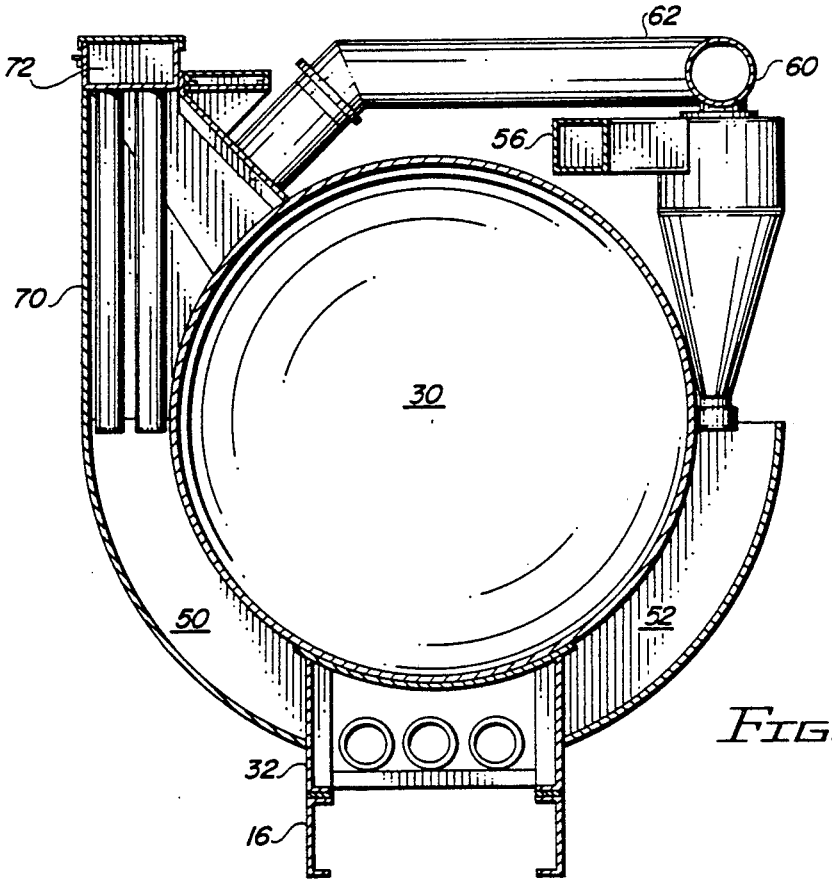
FIG. 4 is a view taken along the line 4—4 of FIG. 2.
Figure 5:
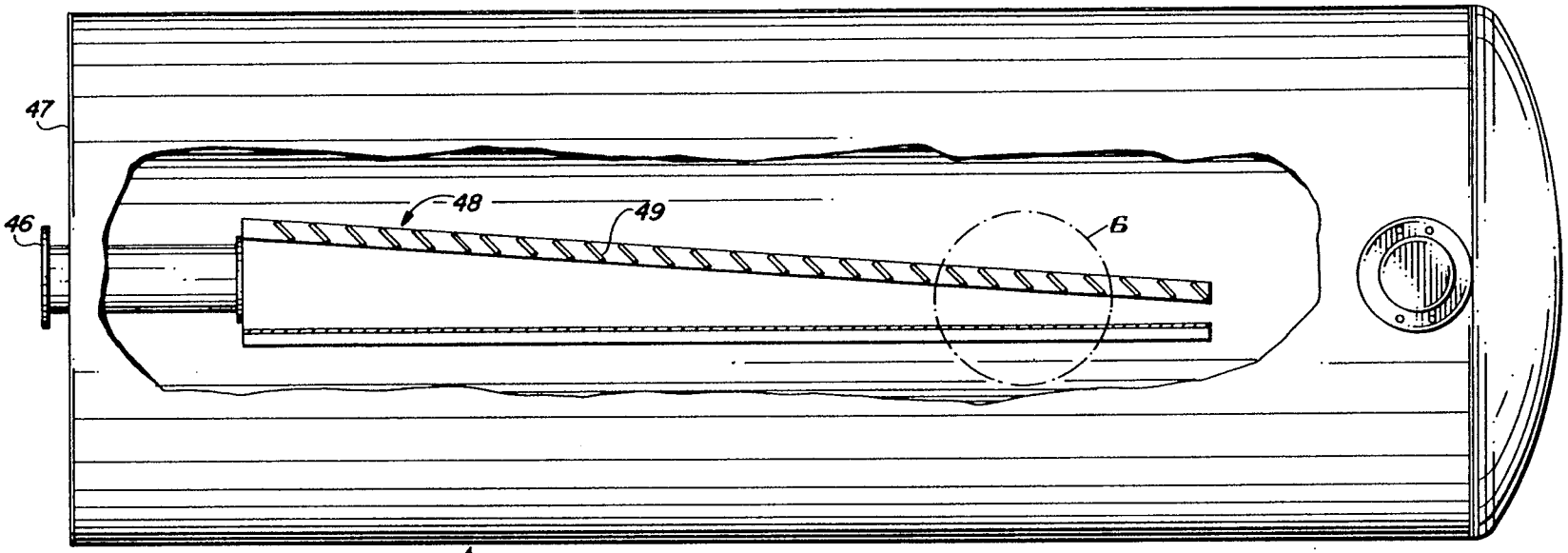
FIG. 5 is a view similar to FIG. 2, partially broken away to show the receptacle interior.
Figure 6:
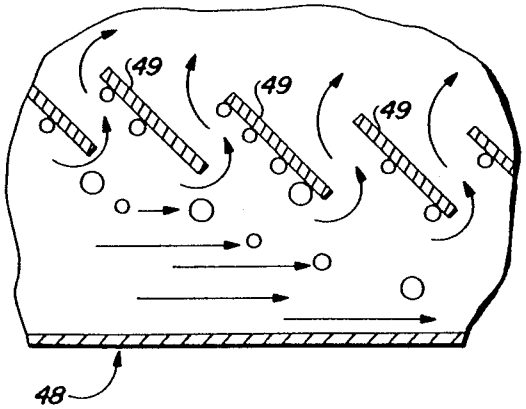
FIG. 6 is a view taken within the circle "6" of FIG. 5.

In accordance with one feature of the instant invention, as best seen in FIGS. 1 and 4, pair of saddle tanks 50 and 52 are disposed on opposite sides of the cylindrical receptacle 30 in generally concentric relation thereto. The saddle tanks 50 and 52 extend substantially the entire length of the receptacle 30 and share a common wall therewith. A plurality of cyclone air filters 54 are mounted on the saddle tank 52 for discharge of large dust particles downwardly thereinto. Each of the cyclone filters 54 is fed from a common plenum 56 that extends longitudinally of the receptacle 30 and is connected thereto through a like plurality of tangentially related connectors 58.

Figure 2:
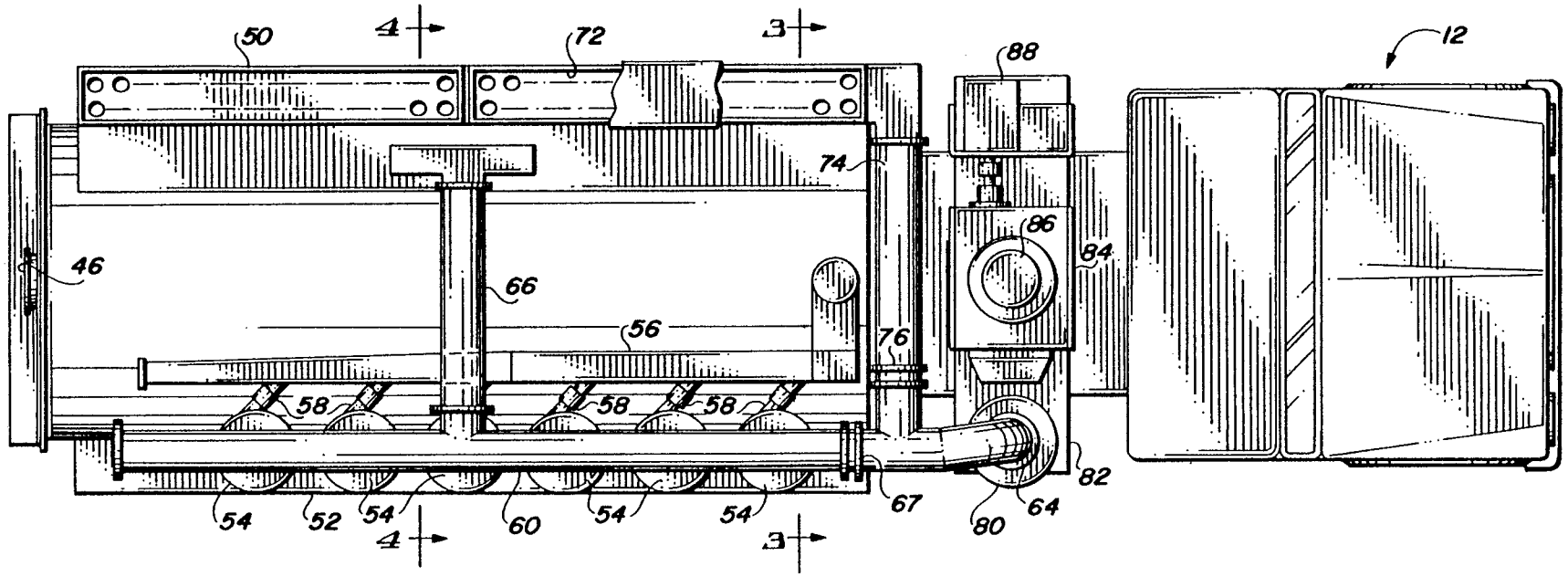
FIG. 2 is a view taken in the direction of the arrow 2 of FIG. 1, partially broken away for clarity.
Figure 3:
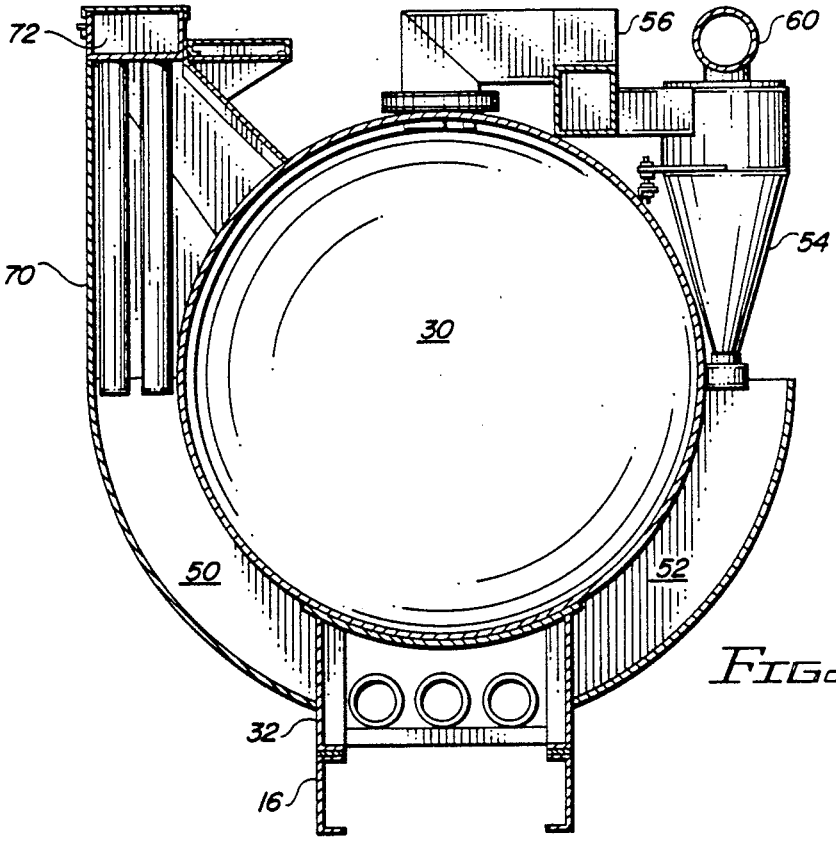
FIG. 3 is a view taken along the line 3—3 of FIG. 2.

It is to be noted that, as best seen in FIGS. 2 and 3, the plenum 56 tapers rearwardly of the receptacle 30 to effect an increase in the velocity of air flow longitudinally of the plenum 56, thereby to ensure equal distribution of air to the cyclones 54 connected thereto.

Air is discharged from the cyclone filters 54 through the top thereof and collected in a plenum 60 that extends longitudinally of the receptacle 30. Air in the plenum 60 can flow directly through a valve 62 to a coupler 64 or, as best seen in FIG. 2, through a transverse conduit 66 that intersects the plenum 60 at a midpoint thereof and is connected to the starboard saddle tank 50.

The starboard saddle tank 50 is provided with a longitudinally extending array of bag filters 70 which discharge debris downwardly into the bottom of the tank 50. Air flows upwardly through the bag filters 70 to a plenum 72 that extends longitudinally of the receptacle 30. The plenum 72 is connected by a transverse conduit 74, and a valve 76 to the coupler 64.

The coupler 64 is removably attachable to a final 40 mesh screen filter 80 which is mounted above a vacuum pump plenum 82. A vacuum pump 84 is mounted on the plenum 82, exhaust of air therefrom discharging to atmosphere through a silencer and exhaust stack 86. The vacuum pump 84 is driven by a conventional hydraulic motor 88 which, in turn, is driven by a conventional hydraulic pump connected to the prime mover (not shown) of the vehicle 12.

From the foregoing it should be apparent that control of the system 10 is achieved through control of the valves 62 and 76 to include or bypass the bag filters 70, selectively.

While the preferred embodiment of the invention has been disclosed, it should be appreciated that the invention is susceptible of modification without departing from the scope of the following claims.

I claim:

1. A vacuum system comprising:

a vacuum pump;

a debris receptacle having an inlet for the acceptance of air and debris along a longitudinal axis extending through the inlet and an air outlet;

an air scrubber disposed within said receptacle comprising a plurality of vertically extending angular related plates which are aligned at a predetermined angle to the longitudinal axis of the debris receptacle;

a first air filter stage comprising a first air inlet plenum connected to the air outlet of said debris receptacle, an air outlet plenum, a plurality of cyclone air filters connected in parallel to one another between said air inlet and outlet plenums, and a first dust collection chamber connected to said cyclones;

a second air filter stage comprising a second inlet and dust collection plenum connected to the air outlet plenum at said first air filter stage, a second air outlet plenum, a plurality of bag-type filter elements connected in parallel relationship, between said second inlet and outlet plenums; and valve means for connecting the outlet plenum of said first air filter stage to said vacuum pump and disconnected the outlet plenum of said second air filter stage from said vacuum pump and for disconnecting the outlet plenum of said first filter stage from said vacuum pump and connecting the outlet plenum of said second air filter stage to said vacuum pump, selectively.

2. The vacuum system in accordance with claim 1 wherein said first inlet plenum comprises an elongated tapered chamber and said cyclone filters are connected at spaced locations along said chamber and having successively reduced cross-sections.

3. The vacuum system in accordance with claim 1 wherein said first and second filter stages are horizontally aligned on opposite sides of said receptacle.

4. The vacuum system in accordance with claim 1 wherein said valve means comprises a pair of independently operable valves.

5. A vacuum system comprising:

a vacuum pump;

a debris receptacle having an inlet for the acceptance of air and debris, and an air outlet;

means disposed within said receptacle with a rear end disposed adjacent the inlet and a front end disposed adjacent the outlet for impacting small and large debris entrained in air flowing through said receptacle in a manner where small particles are impacted and dropped, and where large particles are carried forward within said receptacle and are dispersed near the front end thereof; and means for connecting the air outlet to said vacuum pump.

6. The system as recited in claim 5, wherein said receptacle has a longitudinal axis extending through the inlet, and wherein said impacting means comprises a plurality of angular related plates which are aligned at a predetermined angle to the longitudinal axis of the debris receptacle and which partially extend into air flowing through said receptacle.

* * * * *